US007866798B2

(12) United States Patent
Sakurai et al.

(10) Patent No.: US 7,866,798 B2
(45) Date of Patent: Jan. 11, 2011

(54) HEAD CARTRIDGE, PRINTHEAD, AND SUBSTRATE HAVING DOWNSIZED LEVEL CONVERSION ELEMENTS THAT SUPPRESS POWER CONSUMPTION

(75) Inventors: Masataka Sakurai, Kawasaki (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 12/202,648

(22) Filed: Sep. 2, 2008

(65) Prior Publication Data

US 2009/0058494 A1 Mar. 5, 2009

(30) Foreign Application Priority Data

Sep. 3, 2007 (JP) ..... 2007-228280
Aug. 27, 2008 (JP) ..... 2008-218824

(51) Int. Cl.
*B41J 29/38* (2006.01)
*B41J 2/05* (2006.01)

(52) U.S. Cl. ..... 347/58; 347/12

(58) Field of Classification Search ..... 347/57, 347/58, 59

See application file for complete search history.

(56) References Cited

U.S. PATENT DOCUMENTS 6,290,334 B1 9/2001 Ishinaga et al.
6,302,504 B1 10/2001 Imanaka et al.
7,317,346 B2 * 1/2008 Chu et al. ..... 327/530
2002/0011889 A1 * 1/2002 Takenaka ..... 327/333
2003/0090546 A1 * 5/2003 Mochizuki et al. ..... 347/58
2004/0160258 A1 * 8/2004 Tobita ..... 327/333
2006/0139412 A1 6/2006 Sakurai et al.
2008/0129790 A1 6/2008 Kasai
2009/0135229 A1 * 5/2009 Kurokawa et al. ..... 347/59

FOREIGN PATENT DOCUMENTS

JP 2005-169868 A 6/2005

* cited by examiner

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

The following arrangement is added to a head substrate including a plurality of electrothermal transducers, a plurality of switching elements which drive the plurality of electrothermal transducers, and a logic circuit which drives the plurality of switching elements. That is, the head substrate includes a plurality of level converters which correspond to the respective switching elements, and apply a voltage obtained by boosting a logic voltage. Further, the head substrate includes a bias circuit which applies a bias voltage lower than the boosted voltage to the plurality of level converters.

11 Claims, 15 Drawing Sheets

HEAD CARTRIDGE, PRINTHEAD, AND SUBSTRATE HAVING DOWNSIZED LEVEL CONVERSION ELEMENTS THAT SUPPRESS POWER CONSUMPTION

BACKGROUND OF THE INVENTION

1. Field of the Invention

The present invention relates to a head substrate, printhead, and head cartridge. Particularly, the present invention relates to a head substrate obtained by forming, on a single substrate, electrothermal transducers for generating heat energy necessary to print, and switching elements for driving the electrothermal transducers, a printhead using the head substrate, and a head cartridge using the printhead.

2. Description of the Related Art

Conventionally, the electrothermal transducer (heater) of an inkjet printhead and a switching element for switching a heater to be driven are formed on a single substrate using a semiconductor process technique, as disclosed in the U.S. Pat. No. 6,290,334. Many proposals have been made for a layout arrangement in which heaters and switching elements are integrated on a head substrate. When an NMOS transistor is employed as a switching element, a level converter (LVC) is integrated on a head substrate to boost a VDD voltage serving as the power supply voltage of a logic circuit in order to improve the drivability of the NMOS transistor. As the arrangement of an LVC array, an arrangement disclosed in the U.S. Pat. No. 6,302,504 is known. Other arrangements of the level converter are one in the United States Patent Publication No. 2006/0139412 and one in Japanese Patent Laid-Open No. 2005-169868.

FIG. 13 is a circuit diagram showing an example of an equivalent circuit including a heater 203 and driver transistor 204.

A logic circuit such as a shift register (S/R) (not shown) or a decoder (not shown) processes a heater driving signal. The processed signal is output with the amplitude of a logic voltage (VDD voltage) of about 3.3 V from an AND gate 206 serving as the final stage of the logic circuit. For illustrative convenience, an output from the logic circuit is expressed as an output from the AND gate in FIG. 13. A level converter 205 converts the output signal from the AND gate to have the amplitude of the second power supply voltage VHT higher than the VDD voltage. This output voltage drives the gate of the driver transistor 204 serving as a switching element for driving a heater.

The effective resistance of the driver transistor in driving the heater 203 is reduced by driving the gate of the driver transistor 204 by a voltage higher than the VDD voltage.

In FIG. 13, a plurality of circuit blocks 210 each having an array of identical circuits are arranged. Many printing elements and switching elements for them are formed on a single substrate.

FIG. 14 is a circuit diagram showing an example of the conventional level converter 205.

In FIG. 14, reference numerals 301*a* to 301*j* denote elements which constitute the level converter. More specifically, an IN terminal 301*a* receives a signal from the logic circuit formed from an element driving signal circuit (not shown), a block selection circuit (not shown), or the like. An inverter 301*b* receives a signal from the IN terminal 301*a* and outputs the inverted signal. MOS transistors 301*c* to 301*h* constitute a level converter for converting the voltage amplitude of a signal. An inverter 301*i* buffers an output signal from the level converter. An OUT terminal 301*j* outputs a level-converted signal.

A signal input to the IN terminal 301*a* is input to the gates of the PMOS transistor 301*g* and NMOS transistor 301*f*, and the inverter 301*b*. The signal inverted by the inverter 301*b* is input to the gates of the PMOS transistor 301*d* and NMOS transistor 301*c*. Note that the amplitude voltage of an input signal applied to the IN terminal 301*a* and that of an output signal from the inverter 301*b* are the VDD voltage.

A circuit operation when a signal input to the IN terminal 301*a* is at high level (H) (=VDD voltage) will be explained.

The inverted signal of an input signal is applied to the gates of the MOS transistors 301*c* and 301*d*, so a low-level (L) voltage (=0 V) is applied. To the contrary, the input signal is directly applied to the gates of the NMOS transistor 301*f* and PMOS transistor 301*g*, so a high-level (H) voltage is applied. At this time, the NMOS transistor 301*f* is turned on. The drain terminal of the NMOS transistor 301*f* is connected to GND at low impedance.

As shown in FIG. 14, the drain terminal of the NMOS transistor 301*f* is connected to the gate of the PMOS transistor 301*e*. The gate of the PMOS transistor 301*e* is connected to GND at low impedance to turn on the PMOS transistor 301*e*. In contrast, the gate of the PMOS transistor 301*d* series-connected to the PMOS transistor 301*e* receives an output from the inverter 301*b*, and the gate voltage is set to 0 V. At this time, the PMOS transistor 301*e* is ON, and the source potential of the PMOS transistor 301*d* is a VHT voltage higher than the VDD voltage. For this reason, the PMOS transistor 301*d* is turned on regardless of whether the VDD voltage or 0 V is applied.

The gate voltage of the NMOS transistor 301*c* series-connected to the PMOS transistor 301*d* is 0 V, so the NMOS transistor 301*c* is turned off. The PMOS transistors 301*e* and 301*d* are turned on, and the NMOS transistor 301*c* is turned off. As a result, the potential at the node to which the drains of the PMOS transistor 301*d* and NMOS transistor 301*c* are connected and which is connected to the gate of the PMOS transistor 301*h* changes to VHT serving as the power supply potential of the level converter.

Then, the PMOS transistor 301*h* is turned off. Since the PMOS transistor 301*h* is turned off, the NMOS transistor 301*f* is turned on. The voltage at the node to which the drains of the PMOS transistor 301*g* and NMOS transistor 301*f* are connected and which is connected to the gate of the PMOS transistor 301*e* is finalized at 0 V. The potential at this node is input to the inverter 301*i*, and an output signal from the inverter 301*i* serves as an output signal from the level converter. Since the signal input to the inverter 301*i* has 0 V, the output signal changes to high level, and the VHT voltage is output to the OUT terminal 301*j*.

To the contrary, in a circuit operation when a signal input to the IN terminal 301*a* is at low level (0 V), all the logic values are inverted to output 0 V to the OUT terminal.

FIG. 15 is a timing chart including the input signal of the level converter and the gate voltage of the driver transistor at the heater driving timing of a conventional head substrate.

An output pulse HEAT from a logic circuit 206 which defines the timing to energize the heater 203 is applied to the IN terminal of the level converter 205 with an amplitude of 0 V to the VDD voltage.

In response to the timing of the output pulse HEAT, a current IHT consumed by the driving power supply of the driver transistor 204 transiently flows at the leading and trailing edge timings of the output pulse HEAT. A driver transistor 204 corresponding to a heater 203 selected to be driven is connected to the output of the level converter 205, and receives a signal VG_on with an amplitude of 0 V to the VHT voltage. That is, the signal VG_on is a signal obtained by converting the level of the pulse signal HEAT.

Upon receiving the signal VG_on, the driver transistor 204 keeps ON while a gate voltage equal to or higher than a threshold Vth is applied, and a current IH_on flows through the heater 203. To the contrary, a signal VG_off (=0 V) is applied to a driver transistor 204 corresponding to an unselected heater 203, and no heater current flows. In FIG. 15, a current IH_off represents this.

Recently, an inkjet printing apparatus having a printhead using the above-described head substrate is enhancing the density of nozzles for discharging ink. This means arranging heaters at high density. For this purpose, corresponding driver transistors, level converters (LVCs), and logic circuits need to be arranged at high density. To deal with the recent enhancement in nozzle density, circuits must be arranged at pitches of about ten-odd to several tens of μm. As for the logic circuit, we can cope with the high-density arrangement by miniaturizing a circuit manufactured by a semiconductor manufacturing process, to some extent.

However, a circuit such as a level converter which needs to operate at a voltage higher than the logic voltage must employ a high-voltage tolerant element structure because it needs to assure a tolerable level against a high voltage. However, there is a limit on integrating high-voltage tolerant element structures by the miniaturization process, and it is difficult to arrange them at high density.

Since an attempt to miniaturize devices is difficult, an approach to increasing the density by reducing the number of elements (number of transistors) may be considered.

A transistor serving as a building component of a conventional level converter is necessary to cut off, after switching, a current flowing through the level converter. If the number of transistors decreases, the current keeps flowing depending on the logic state. As a result, the level converter consumes an enormous amount of current.

FIG. 16 is a circuit diagram showing the principle circuit arrangement of a level converter in which an NMOS transistor is series-connected to a resistance load. This level converter inverts a logic signal input to the IN terminal with the amplitude of the VHT voltage, and outputs the inverted signal to the OUT terminal.

The arrangement shown in FIG. 16 can reduce the number of elements, compared to the conventional level converter. However, the power supply current always keeps flowing via the resistor and NMOS transistor in a case where a high-level logic signal is input (a low-level logic signal is output).

In a recent printhead in which many nozzles and switching elements are arranged at high density, even a slight increase in current consumption per nozzle (heater) leads to a large current as a whole, raising the head temperature. Particularly, the temperature rise of the head seriously influences discharge characteristics, degrading the print quality.

SUMMARY OF THE INVENTION

Accordingly, the present invention is conceived as a response to the above-described disadvantages of the conventional art.

For example, a head substrate, printhead using the head substrate, and head cartridge using the printhead according to this invention are capable of reducing the number of elements of a level converter and stably printing at high quality while suppressing power consumption.

According to one aspect of the present invention, preferably, there is provided a head substrate including a plurality of electrothermal transducers, a plurality of switching elements for respectively driving the plurality of electrothermal transducers, and a logic circuit for driving the plurality of switching elements, the head substrate comprising: a plurality of level converters which are arranged in correspondence with the respective switching elements, boost a logic voltage from the logic circuit, and apply the boosted voltage to the respective switching elements; and a bias circuit which controls whether or not to boost the logic voltage.

According to another aspect of the present invention, preferably, there is provided a head substrate including a plurality of electrothermal transducers, a plurality of switching elements for respectively driving the plurality of electrothermal transducers, and a logic circuit for driving the plurality of switching elements, the head substrate comprising: a plurality of level converters which are arranged in correspondence with the respective switching elements, boost a logic voltage from the logic circuit, and apply the boosted voltage to the respective switching elements; and a bias circuit which outputs, to the plurality of level converters, a bias signal for setting a period during which the plurality of level converters can boost the logic voltage, wherein the plurality of level converters boost the logic voltage in accordance with the bias signal from the bias circuit and a signal from the logic circuit.

According to still another aspect of the present invention, preferably, there is provided a printhead using any of the above-mentioned head substrates.

According to still another aspect of the present invention, preferably, there is provided a head cartridge integrating any of the above-mentioned printheads and an ink tank containing ink to be supplied to the printhead.

The invention is particularly advantageous since a current flowing through series-connected PMOS and NMOS transistors which constitute a level converter can be controlled to be small, decreasing the power consumption of the level converter. Heat generated by the head substrate having the level converter can be suppressed to suppress the temperature rise of the printhead.

Particularly on a head substrate having many heaters, the power consumption reduction effect is great, so the effect of suppressing heat generation of the printhead becomes considerable. For example, this contributes to stable ink discharge in an inkjet printhead and high quality printing.

Since the level converter is formed from only a pair of PMOS and NMOS transistors at minimum, the circuit scale reduces, contributing to downsizing of the entire head substrate.

Further features of the present invention will become apparent from the following description of exemplary embodiments with reference to the attached drawings.

DESCRIPTION OF THE EMBODIMENTS

Figure 1:
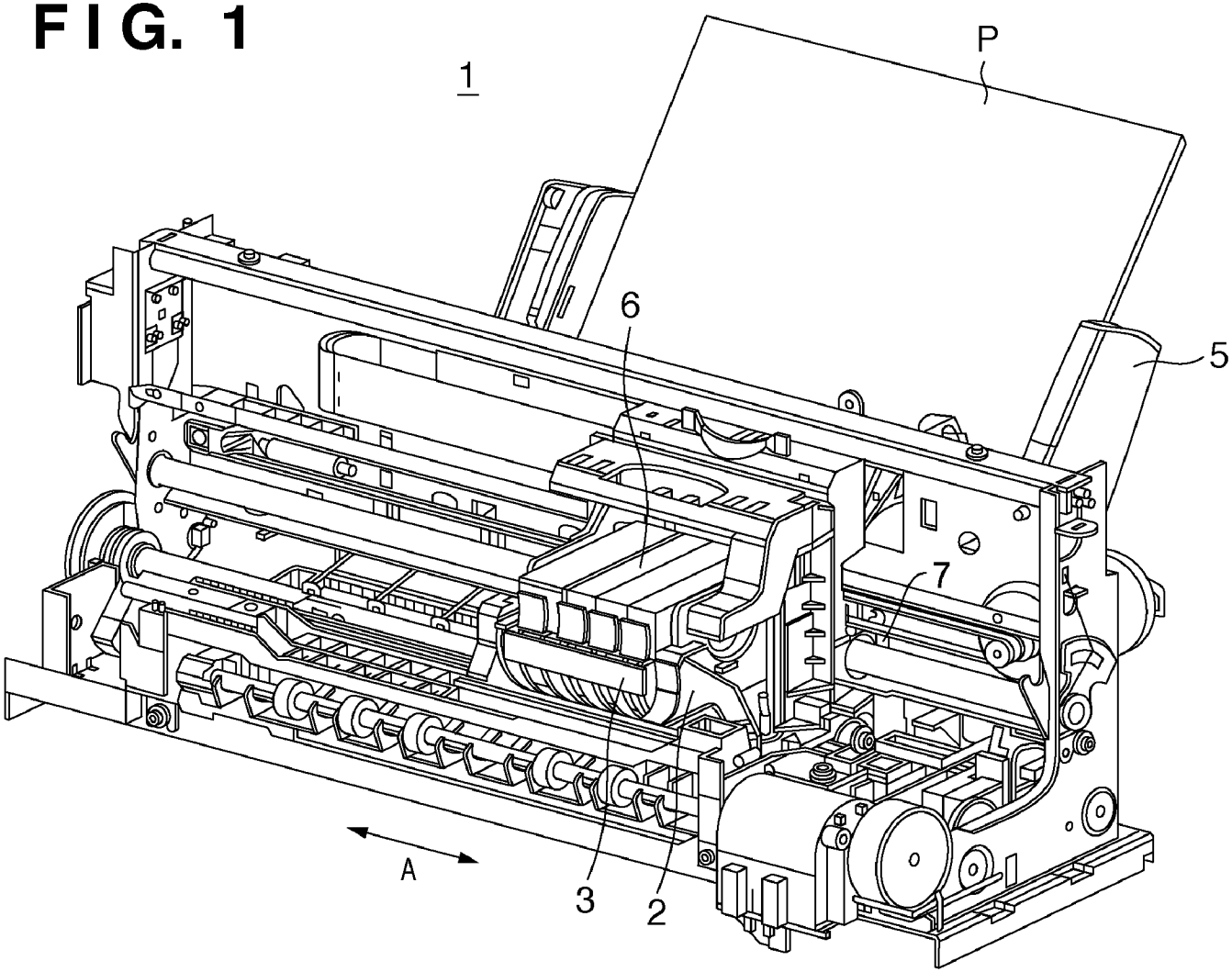
FIG. 1 is a schematic perspective view showing the outer appearance of an inkjet printing apparatus according to the present invention.

Preferred embodiments of the present invention will now be described in detail in accordance with the accompanying drawings. Note that the same reference numerals are added to constituent elements already explained, and the description thereof will not be repeated.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Furthermore, unless otherwise stated, the term "printing element" generally means a set of a discharge orifice, a liquid channel connected to the orifice and an element to generate energy utilized for ink discharge.

The term "printhead substrate (head substrate)" in the following description not only includes a substrate made of a silicon semiconductor, but also broadly includes a substrate on which elements, wiring lines, and the like are arranged.

The term "on a substrate" not only includes "on an element substrate", but also broadly includes "on the surface of an element substrate" and "inside of an element substrate near its surface".

<Description of Inkjet Printing Apparatus (FIG. 1)>

FIG. 1 is a schematic perspective view showing the outer appearance of the structure of an inkjet printing apparatus 1 as a typical embodiment of the present invention.

In the inkjet printing apparatus (to be referred to as a printing apparatus hereinafter), as shown in FIG. 1, a carriage 2 supports a printhead 3 for printing by discharging ink according to the inkjet method. The carriage 2 reciprocates in directions indicated by an arrow A, thereby printing. A print medium P such as print paper is fed via a paper feed mechanism 5 and conveyed to a print position. At the print position, the printhead 3 prints by discharging ink to the print medium P.

The carriage 2 of the printing apparatus 1 supports not only the printhead 3, but also an ink cartridge 6 which contains ink to be supplied to the printhead 3. The ink cartridge 6 is detachable from the carriage 2.

The printing apparatus 1 shown in FIG. 1 can print in color. For this purpose, the carriage 2 supports four ink cartridges which respectively contain magenta (M), cyan (C), yellow (Y), and black (K) inks. The four ink cartridges are independently detachable.

The printhead 3 according to the embodiment adopts an inkjet method of discharging ink by using heat energy. For this purpose, the printhead 3 comprises an electrothermal transducer. The electrothermal transducer is arranged in correspondence with each orifice. By applying a pulse voltage to an electrothermal transducer corresponding to a print signal, ink is discharged from a corresponding orifice.

<Control Arrangement of Inkjet Printing Apparatus (FIG. 2)>

Figure 2:
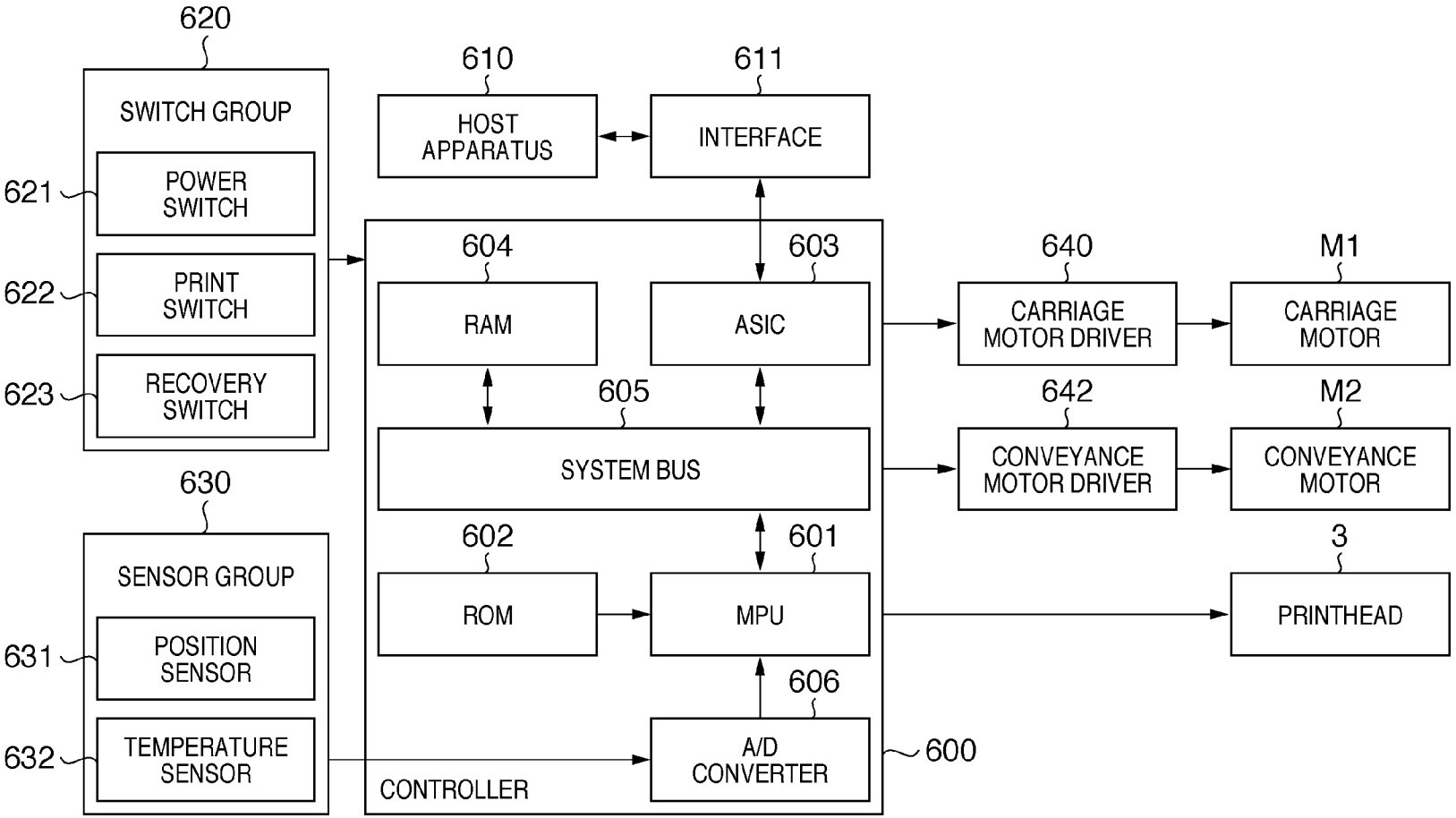
FIG. 2 is a block diagram of the control circuit of the printing apparatus according to the present invention.

FIG. 2 is a block diagram showing the control arrangement of the printing apparatus shown in FIG. 1.

As shown in FIG. 2, a controller 600 comprises a MPU 601, ROM 602, ASIC (Application Specific Integrated Circuit) 603, RAM 604, system bus 605, and A/D converter 606. The ROM 602 stores a program corresponding to a control sequence, a predetermined table, and other permanent data. The ASIC 603 generates control signals for controlling a carriage motor M1, a conveyance motor M2, and the printhead 3. The RAM 604 is used as an image data rasterization area, a work area for executing a program, and the like. The system bus 605 connects the MPU 601, ASIC 603, and RAM 604 to each other, and allows exchanging data. The A/D converter 606 receives analog signals from a sensor group (to be described below), A/D-converts the analog signals, and supplies digital signals to the MPU 601.

In FIG. 2, a computer (or an image reader, digital camera, or the like) 610 serves as an image data source and is generically called a host apparatus. The host apparatus 610 and printing apparatus 1 transmit/receive image data, commands, status signals, and the like via an interface (I/F) 611. Image data is input as, e.g., raster data.

A switch group 620 includes a power switch 621, print switch 622, and recovery switch 623.

A sensor group 630 detects an apparatus state, and includes a position sensor 631 and temperature sensor 632.

A carriage motor driver 640 drives the carriage motor M1 for reciprocating the carriage 2 in the directions indicated by the arrow A. A conveyance motor driver 642 drives the conveyance motor M2 for conveying the print medium P.

The ASIC 603 transfers driving data DATA of a printing element (discharge heater) to the printhead while directly accessing the storage area of the RAM 604 in printing and scanning by the printhead 3.

In the structure shown in FIG. 1, the ink cartridge 6 and printhead 3 are separable from each other, but may also be integrated into an exchangeable head cartridge.

Figure 3:
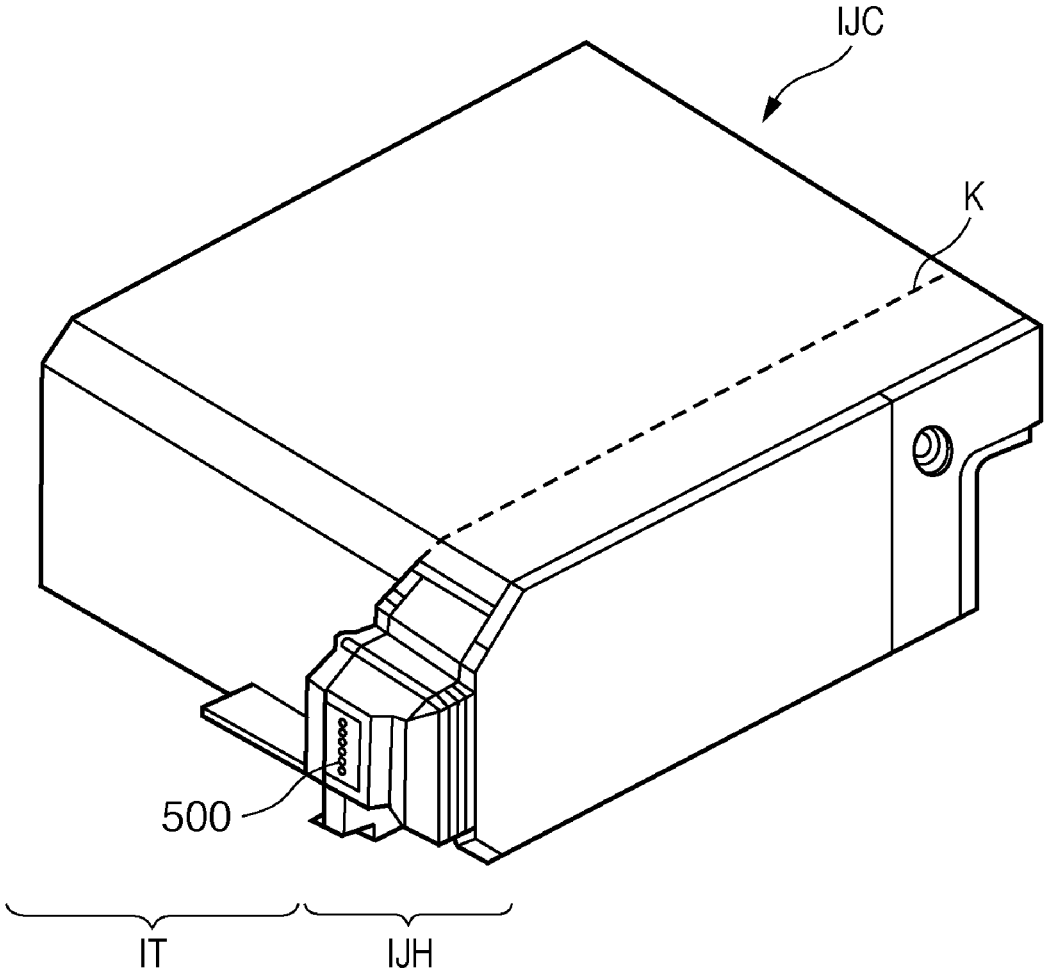
FIG. 3 is a perspective view showing the outer appearance of the structure of a head cartridge.

FIG. 3 is a perspective view showing the outer appearance of the structure of a head cartridge IJC which integrates the ink tank and printhead. In FIG. 3, a dotted line K indicates the boundary between an ink tank IT and a printhead IJH. The head cartridge IJC has an electrode (not shown) to receive an electrical signal supplied from the carriage 2 when the head cartridge IJC is mounted on the carriage 2. The electrical signal drives the printhead IJH to discharge ink, as described above.

In FIG. 3, reference numeral 500 denotes an ink orifice array.

Figure 4:
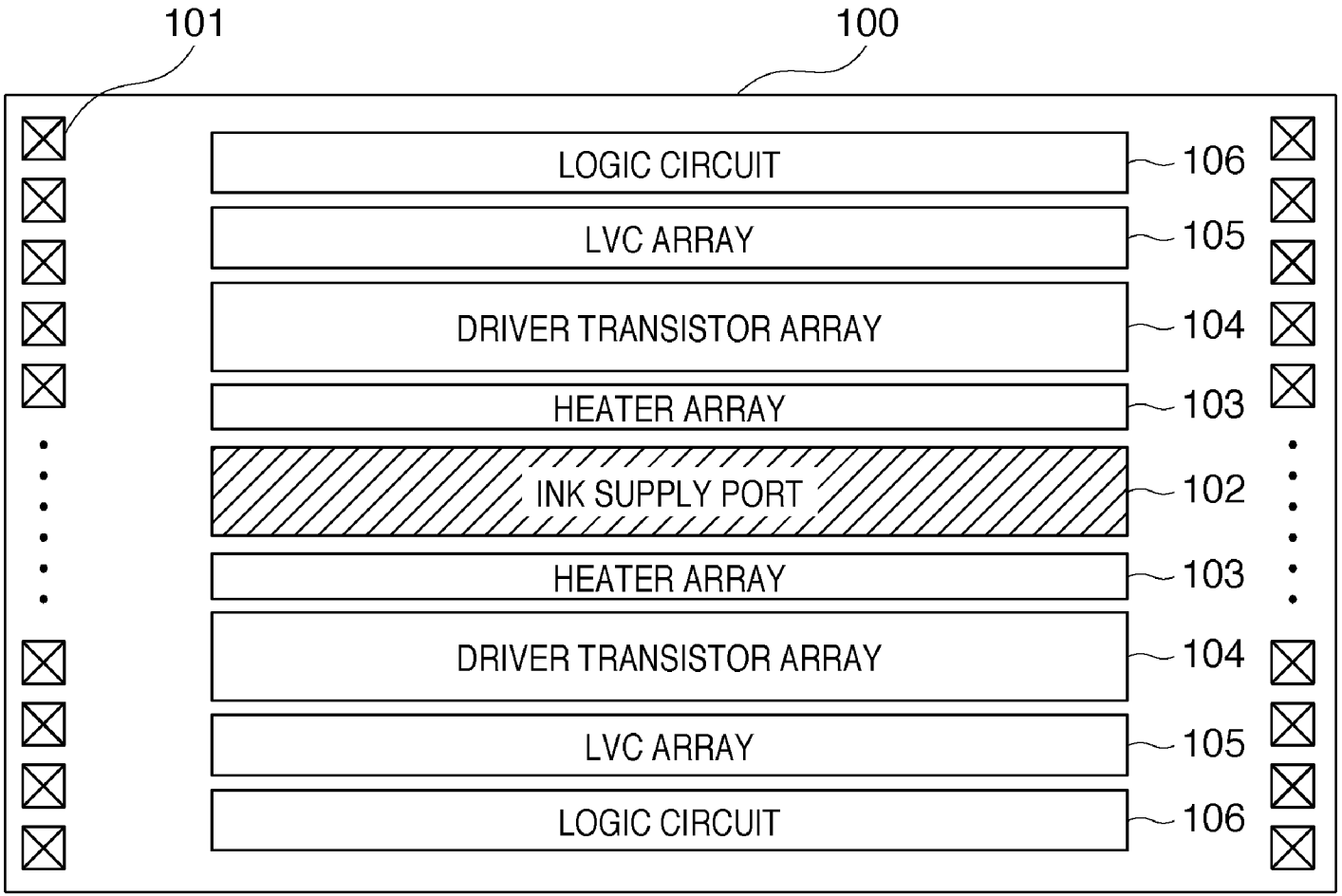
FIG. 4 is a view showing the layout arrangement of a head substrate.

FIG. 4 is a view showing the layout arrangement of a head substrate which is integrated in the printhead 3 and on which heaters and switching elements are arranged.

As shown in FIG. 4, an ink supply port 102 for supplying ink from the lower surface of the substrate is formed near the center of a head substrate 100. Heater arrays 103, driver transistor arrays 104, LVC arrays 105, and logic circuits 106 are arranged to face each other via the ink supply port 102.

Pads 101 for power supply terminals and signal terminals which electrically connect the heaters and logic circuits to the outside are arranged on the shorter side of the head substrate 100, and connected to internal circuits via aluminum (Al) wires.

The LVC array 105 employs an NMOS transistor as a heater switching element. In this arrangement, in order to improve the drivability of the NMOS transistor, the power supply voltage VDD of the logic circuit 106 is boosted to apply the boosted voltage to the gate of the NMOS transistor. The VDD voltage serving as the power supply voltage of the logic circuit is, e.g., 3.3 V or 5 V.

Several embodiments of the head substrate used in the printhead and the printing apparatus having the above-described arrangement will be described.

First Embodiment

Figure 5:
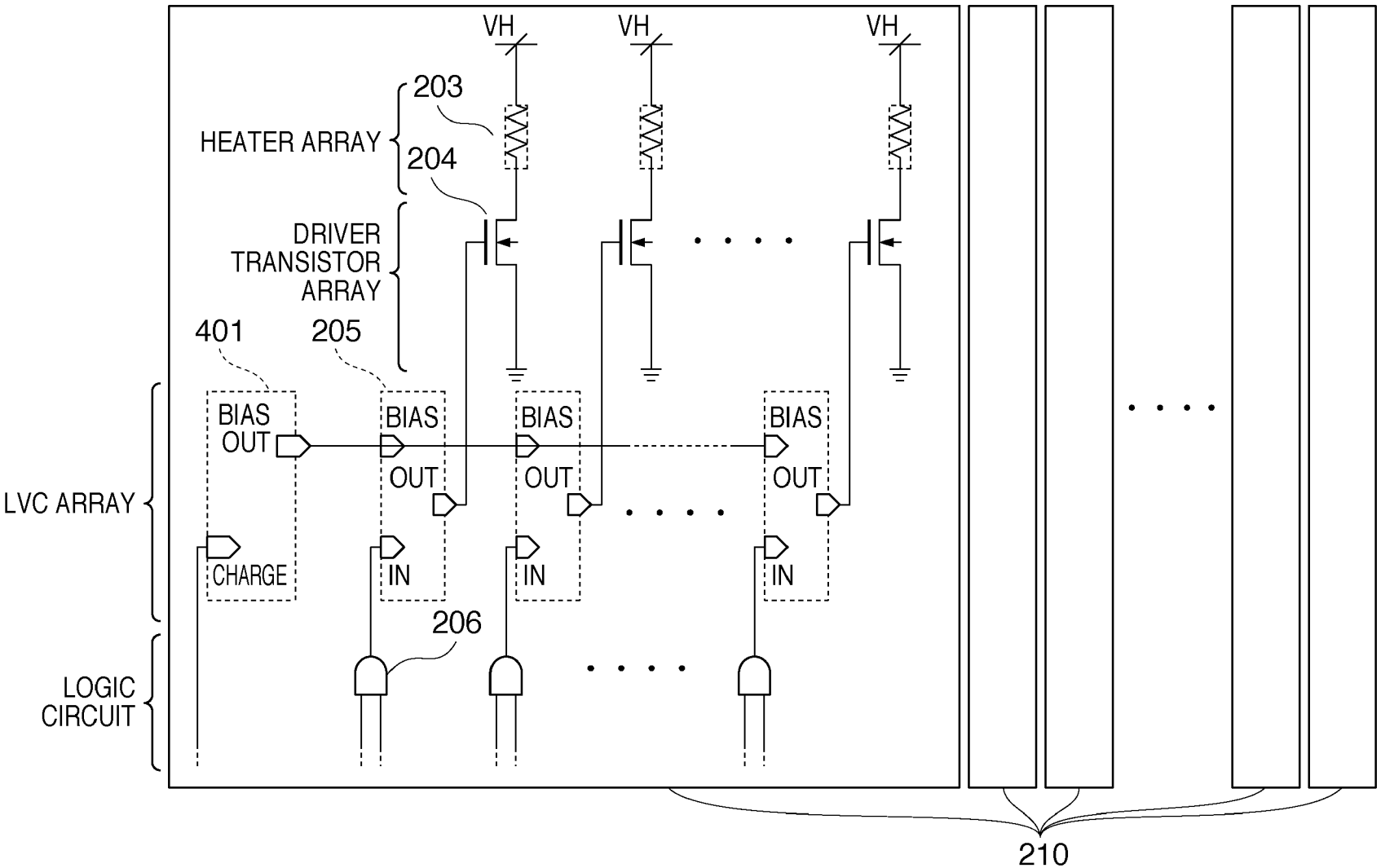
FIG. 5 is a circuit diagram showing an equivalent circuit integrated on a head substrate according to the first embodiment.

FIG. 5 is a circuit diagram showing an equivalent circuit which is integrated on a head substrate and includes a level converter, heater, and driver transistor according to the first embodiment. In FIG. 5, the same reference numerals as those described in the prior art denote the same parts, and a description thereof will not be repeated.

On this head substrate, similar to the prior art, a signal for driving a heater is processed by an AND gate 206 serving as a heater selector which forms part of a logic circuit. Then, the processed signal is output with the amplitude of a logic voltage (VDD voltage). A level converter 205 boosts the output voltage to have the amplitude of the second power supply voltage VHT higher than the VDD voltage. The boosted voltage drives the gate of a driver transistor 204.

Figure 13:
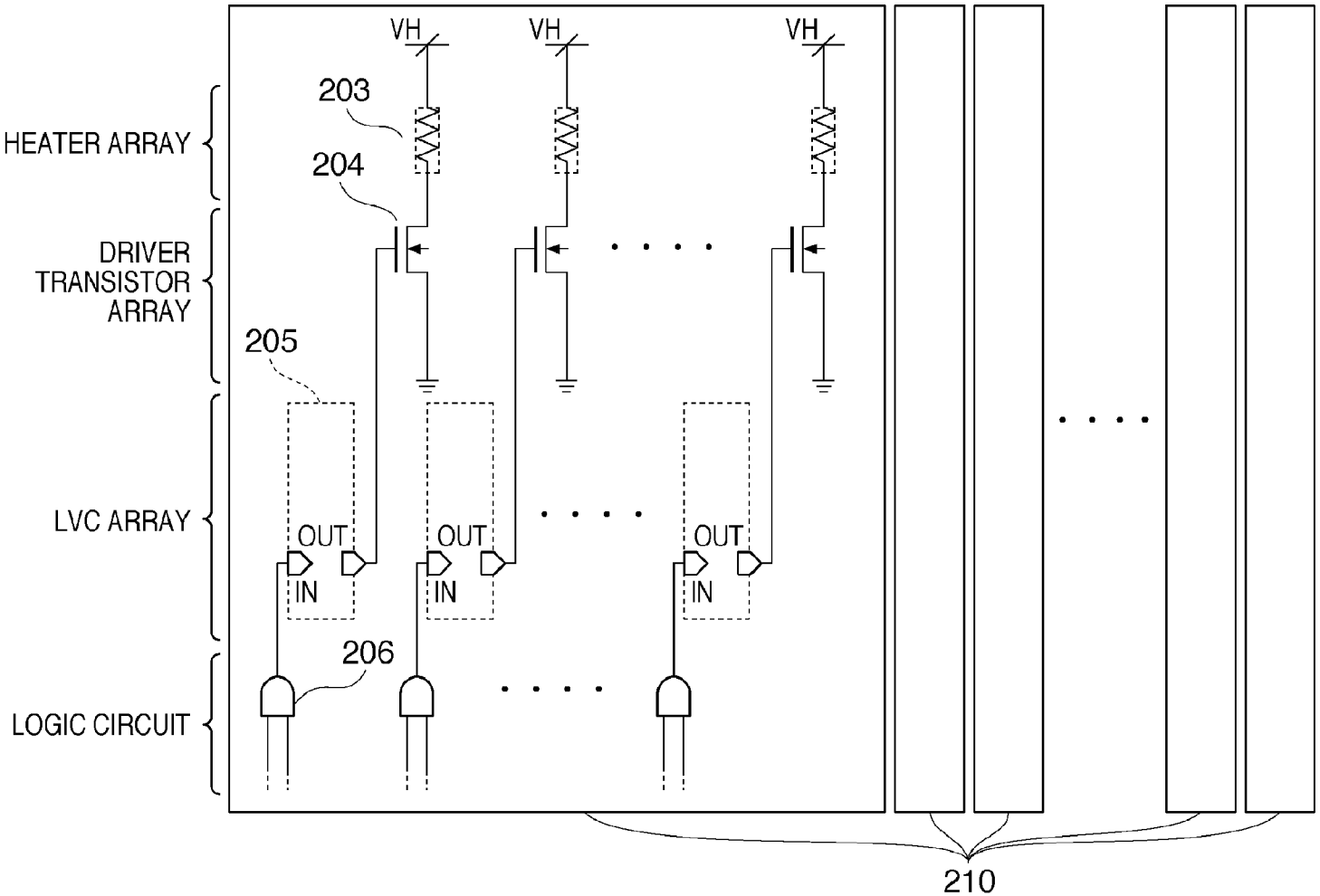
FIG. 13 PRIOR ART
FIG. 13 is a circuit diagram showing the equivalent circuit of a conventional head substrate.

As is apparent from a comparison between FIGS. 5 and 13, the head substrate according to the first embodiment comprises a bias circuit 401 for controlling the operation of the level converter 205.

The bias circuit 401 receives a bias control signal (not shown) at a CHARGE terminal, and changes an output voltage from a BIAS OUT terminal to a bias signal at the timing of a signal applied to the CHARGE terminal. The output voltage from the BIAS OUT terminal is applied to the BIAS terminal of each level converter 205 to control the operating state of the level converter. That is, the bias circuit 401 outputs a bias signal for setting a period during which the level converter 205 can boost the voltage.

Figure 6:
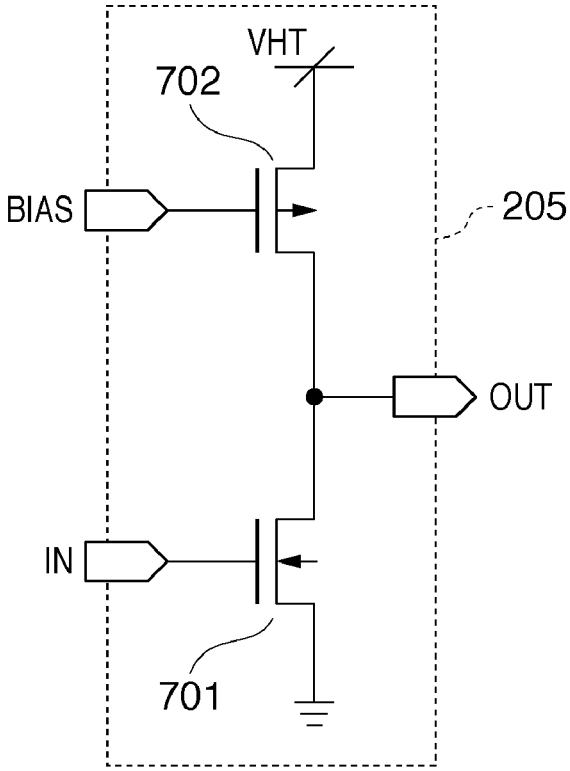
FIG. 6 is a circuit diagram showing the arrangement of a level converter according to the first embodiment.

FIG. 6 is a circuit diagram showing the arrangement of the level converter 205 according to the first embodiment.

In the level converter according to the first embodiment, an input signal with the amplitude of the VDD voltage, which is subjected to level conversion, is applied from the IN terminal to an NMOS transistor 701. The level converter outputs the level-converted signal as an output signal from the OUT terminal.

As shown in FIG. 6, the level converter 205 is connected via a PMOS transistor 702 series-connected to the NMOS transistor 701 to a VHT power supply serving as a power supply voltage subjected to level conversion. A bias voltage output from the bias circuit 401 is applied to the gate of the PMOS transistor 702 via the BIAS terminal.

Figure 7:
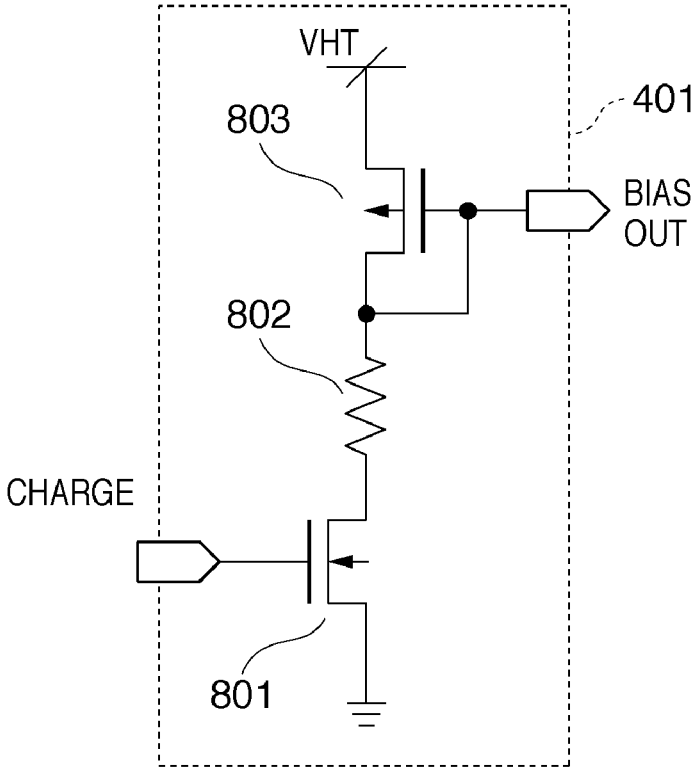
FIG. 7 is a circuit diagram showing the arrangement of a bias circuit according to the first embodiment.

FIG. 7 is a circuit diagram showing the arrangement of the bias circuit 401 for controlling an operation of whether or not to convert the amplitude of the VDD voltage into that of the second voltage higher than the VDD voltage by the level converter 205.

The bias circuit 401 includes an NMOS transistor 801, PMOS transistor 803, and current-limiting resistor (current limiter) 802. The gate of the NMOS transistor 801 is connected to the CHARGE terminal for receiving a signal having the amplitude of the VDD voltage from the outside. The source of the PMOS transistor 803 is connected to the VHT power supply voltage, and the node at which the gate and drain are short-circuited is connected to the BIAS OUT terminal. One end of the current-limiting resistor 802 is connected to the node of the BIAS OUT terminal, and the other end is connected to the drain of the NMOS transistor 801.

The current-limiting resistor 802 is added to limit a current flowing through the bias circuit, and may also be formed from a transistor or the like as long as it similarly limits the current. An output BIAS OUT from the bias circuit 401 is commonly supplied to a plurality of level converters, as shown in FIG. 5.

The operation of the level converter 205 will be explained.

When a pulse having the amplitude of the VHT voltage is not output from the OUT terminal (no current is supplied to the heater), the VDD voltage is always applied to the IN terminal. When the level converter 205 operates to output the VHT voltage from the OUT terminal (a current is supplied to the heater), the VDD voltage is applied to the CHARGE terminal of the bias circuit 401 to turn on the NMOS transistor 801. At this time, a current flowing in accordance with the resistance value of the current-limiting resistor 802 determines the gate voltage of the PMOS transistor 803. The gate voltage is applied from the BIAS OUT terminal to the BIAS terminal of each level converter 205.

While a voltage for turning on the PMOS transistor 702 is applied to the BIAS terminal, 0 V is applied to the IN terminal of a level converter which causes to output the VHT voltage. Then, the NMOS transistor 701 is turned off. Since the PMOS transistor 702 series-connected to the NMOS transistor 701 is ON, the OUT terminal is at almost the VHT voltage.

Figure 8:
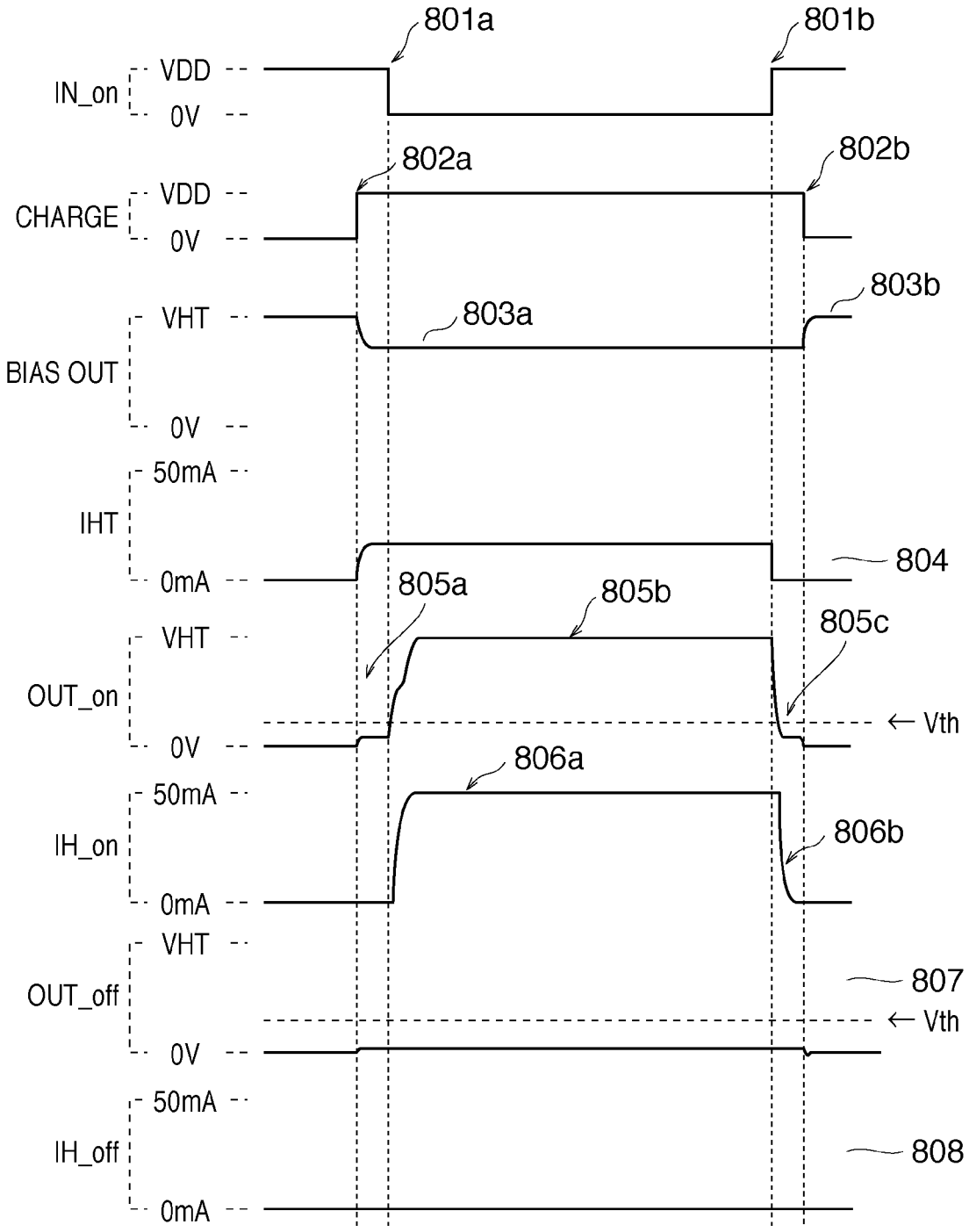
FIG. 8 is a timing chart of input and output signals to and from the level converter and bias circuit according to the first embodiment.

FIG. 8 is a timing chart showing changes of voltages and power supply currents at respective terminals.

A pulse (negative logic) such as a signal IN_on is applied to the IN terminal of a level converter which causes to output a signal having the amplitude of the VHT voltage (801*a* in FIG. 8). Slightly before the signal IN_on changes, a positive-logic pulse signal CHARGE is applied to the CHARGE terminal (802*a* in FIG. 8). The bias circuit 401 outputs a voltage from the BIAS OUT terminal in response to the signal CHARGE. That is, while the VDD voltage is applied to the CHARGE terminal, a voltage for turning on the PMOS transistor 702 is output to the BIAS OUT terminal (803*a* in FIG. 8).

At this time, the same output voltage is applied from the BIAS OUT terminal to the BIAS terminals of the level converters 205. In other words, the output voltage is applied from the BIAS OUT terminal commonly to a level converter which outputs a pulse having the amplitude of the VHT voltage and a level converter which keeps outputting 0 V.

In the level converter which keeps outputting 0 V (i.e., does not drive a heater), both the PMOS transistor 702 and NMOS transistor 701 are turned on. Hence, while the pulse of the signal CHARGE is applied, a current IHT from the VHT power supply flows through the level converter which keeps outputting 0 V. In this timing chart, IHT represents the sum of the current and all currents flowing through other level converters. However, in this case, only a small current limited by the bias circuit 401 flows through each level converter. Thus, the current can be suppressed to a predetermined current value or less (804 in FIG. 8).

As is apparent from FIG. 5, the bias circuit 401 is arranged in each circuit block 210. A circuit block in which no heater is driven does not drive any level converter, and does not consume any current from the VHT voltage. This can suppress the consumption of the current IHT from the VHT power supply by the entire printhead.

In a level converter corresponding to a driver transistor which drives a heater, the PMOS transistor 702 is turned on at the timing when the signal CHARGE is applied. When no signal IN_on is applied, both the PMOS transistor 702 and NMOS transistor 701 are turned on. The voltage division ratio of these transistors determines the potential of the OUT terminal. The PMOS transistor 702 is in the ON state limited by a signal from the BIAS OUT terminal. An output OUT_on from the OUT terminal of the level converter has a voltage lower than a threshold voltage Vth of the driver transistor 204 connected to the level converter (805*a* in FIG. 8).

Subsequently, the signal IN_on is applied to the IN terminal of the level converter 205 to turn off the NMOS transistor 701. Then, only the PMOS transistor 702 is turned on, and the current of the output OUT_on from the OUT terminal flows through the gate of the driver transistor 204. As a result, the voltage from the output OUT_on rises to about the VHT potential (805*b* in FIG. 8).

While the voltage of the output OUT_on is equal to or higher than the threshold voltage Vth of the driver transistor 204, a current IH_on flows through a heater 203 series-connected to the driver transistor 204 (806*a* in FIG. 8). By the current IH_on, the heater 203 generates heat to bubble and discharge ink.

Some level converters in the single circuit block 210 do not drive the heater 203. To the IN terminal of such a level converter, the VDD voltage is kept applied (not shown). In this level converter, both the NMOS transistor 701 and PMOS transistor 702 are turned on, and the PMOS transistor 702 changes to the ON state limited by an output voltage from the BIAS OUT terminal. An output voltage OUT_off from the OUT terminal is a voltage (lower than the threshold voltage Vth) which does not turn on the driver transistor 204 on the next stage (807 in FIG. 8). Thus, no current IH_off flows through the heater (808 in FIG. 8).

When stopping a current supplied to the heater, the signal IN_on changes to the VDD potential (801*b* in FIG. 8) to turn on the NMOS transistor 701 of the level converter 205. After both the PMOS transistor 702 and NMOS transistor 701 are turned on, the voltage of the output OUT_on from the OUT terminal changes to a value equal to or smaller than the threshold voltage Vth (805*c* in FIG. 8). After the output OUT_on becomes equal to or smaller than the threshold voltage Vth, the driver transistor 204 is turned off to stop the current IH_on to the heater (806*b* in FIG. 8). Then, the signal CHARGE changes to 0 V (802*b* in FIG. 8), and the output voltage from the BIAS OUT terminal changes to the VHT voltage (803*b* in FIG. 8). As a result, the PMOS transistor 702 of the level converter 205 is turned off, and the output OUT_on from the OUT terminal changes to 0 V.

As described above, according to the present invention, the bias circuit 401 controls the PMOS transistor 702 of the level converter 205. This makes it possible to form a level converter from a smaller number of transistors than those in the conventional one, while suppressing the current consumption of the level converter.

Figure 9:
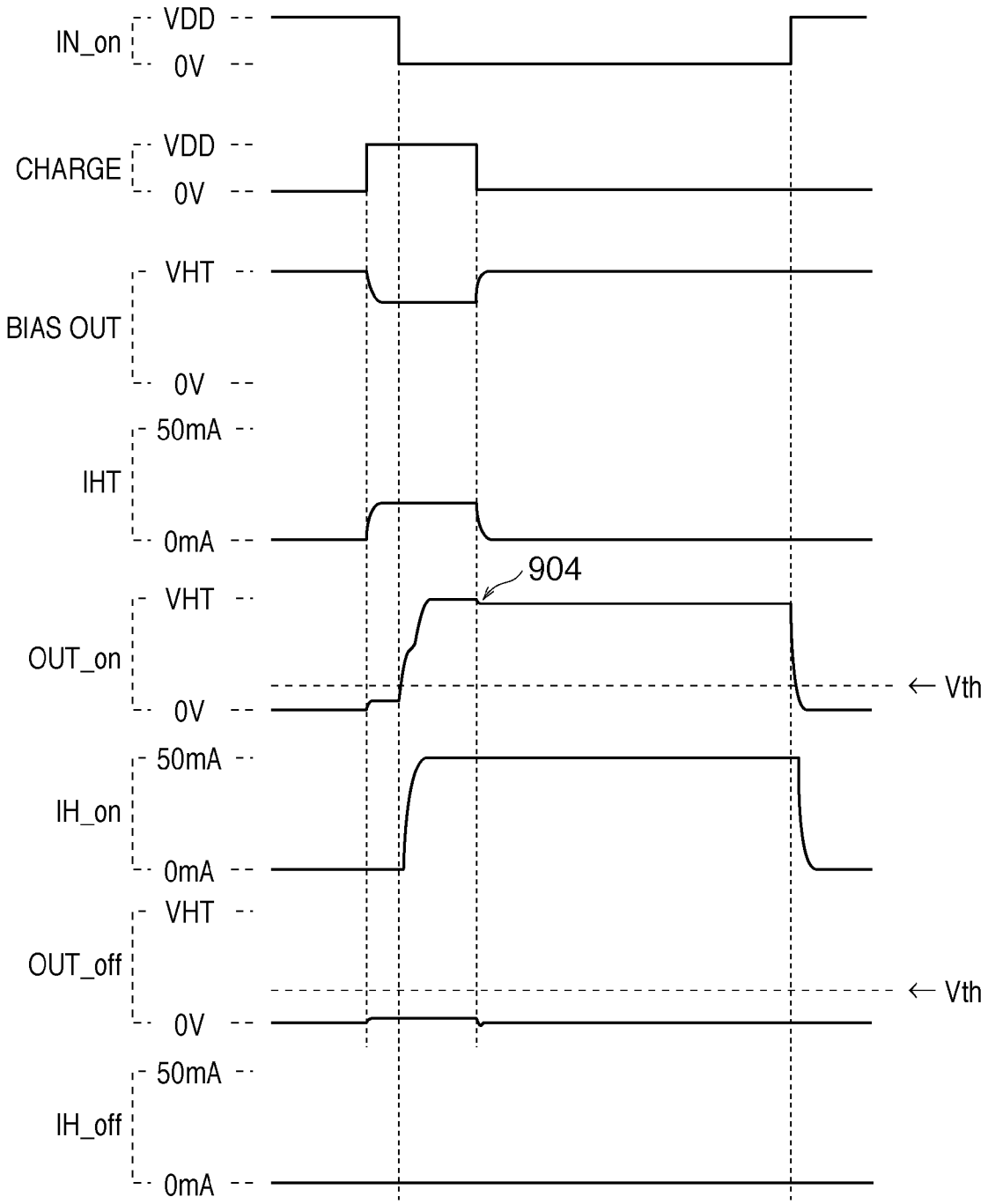
FIG. 9 is a timing chart of input and output signals to and from the level converter and bias circuit which suppress current consumption.

FIG. 9 is a timing chart showing changes of signals for implementing driving which suppresses current consumption.

The difference between the timing charts shown in FIGS. 9 and 8 will be described. In FIG. 9, the signal CHARGE is stopped at the timing when the voltage of the output OUT_on applied to the gate of the driver transistor 204 rises and stabilizes (904 in FIG. 9). This timing is the timing when the gate of the driver transistor 204 is charged.

More specifically, electrical charges are stored in the gate of the driver transistor 204 connected to the OUT terminal. When the voltage becomes a value (≈VHT) much larger than the threshold voltage Vth, both the PMOS transistor 702 and NMOS transistor 701 are turned off, and the node between them floats. As a result, the VHT current consumed by other level converters, to which no VHT voltage is output, stops before the current supplied to a heater by receiving the VDD current at the CHARGE terminal (during this period IN_on changes to 0 V) stops. Outputting no VHT voltage means supplying no power to the heater. The VHT current is IHT.

In the example shown in FIG. 8, an output from the BIAS OUT terminal is active during a period when the output from the BIAS OUT terminal covers the signal IN_on. That is, the current IHT keeps flowing while an input voltage is applied to the BIAS terminal. Compared to this, in the example shown in FIG. 9, the period during which the current IHT flows is shorter (duty is lower). The current consumption by the level converter can be suppressed more than in the example shown in FIG. 8. Accordingly, the temperature rise of the printhead can be suppressed to improve ink discharge characteristics.

Second Embodiment

Figure 10:
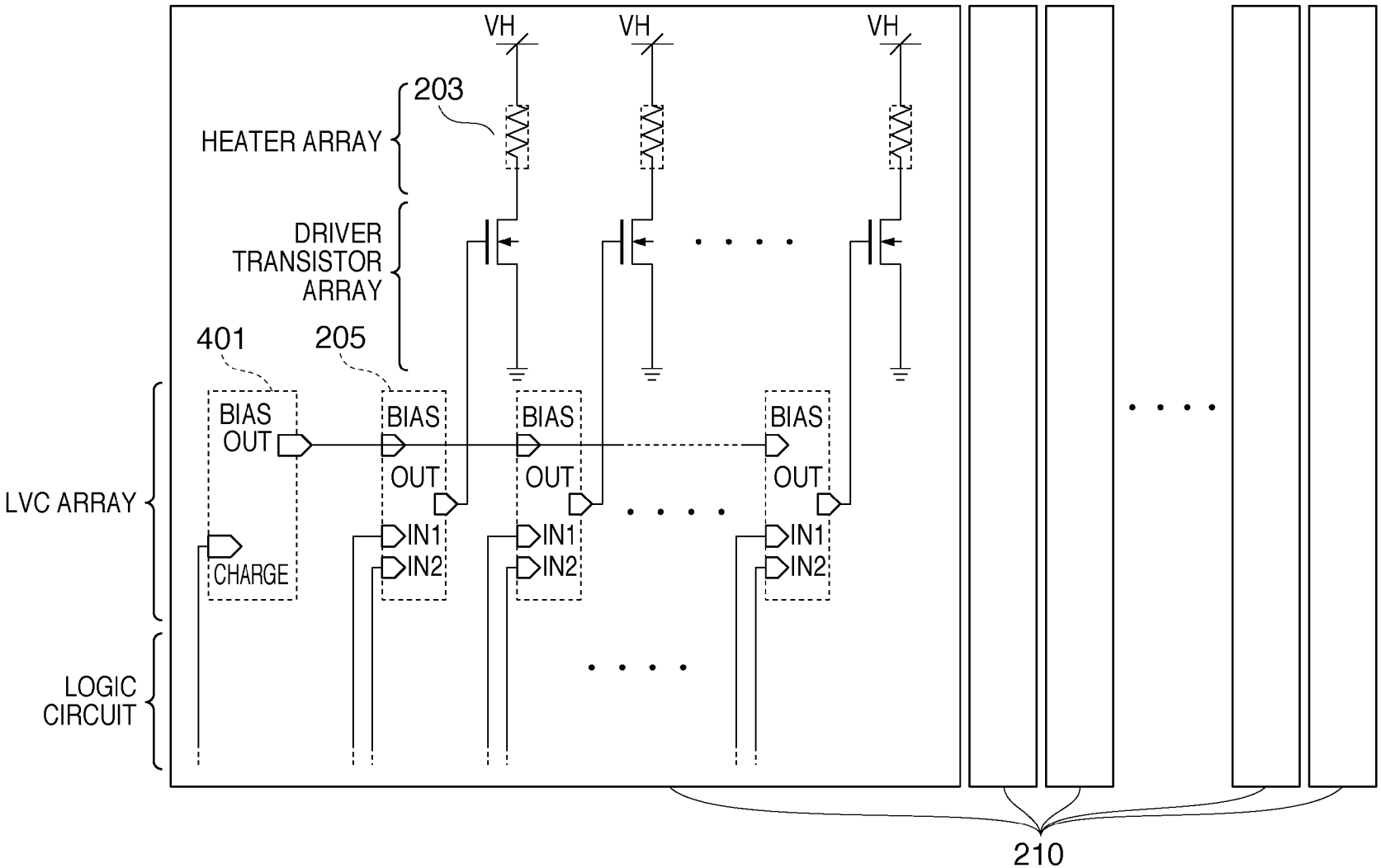
FIG. 10 is a circuit diagram showing the equivalent circuit of a head substrate according to the second embodiment.

FIG. 10 is a circuit diagram showing an equivalent circuit which is integrated on a head substrate and includes a level converter, heater, and driver transistor according to the second embodiment. In FIG. 10, the same reference numerals as those described in the prior art denote the same parts, and a description thereof will not be repeated.

On this head substrate, similar to the prior art, a signal for driving the heater is processed by an AND gate or logic circuit 206, and output with the amplitude of a logic power supply voltage (VDD voltage). The output voltage is applied to two input terminals IN1 and IN2 of a level converter 205.

As is apparent from a comparison between FIGS. 5 and 10, the level converter 205 of the head substrate according to the second embodiment receives a plurality of logic signals. The level converter 205 simultaneously performs logical operation and signal amplitude conversion for these input logic signals. A bias circuit 401 employed in the second embodiment is identical to that shown in FIG. 7 in the first embodiment.

Figure 11:
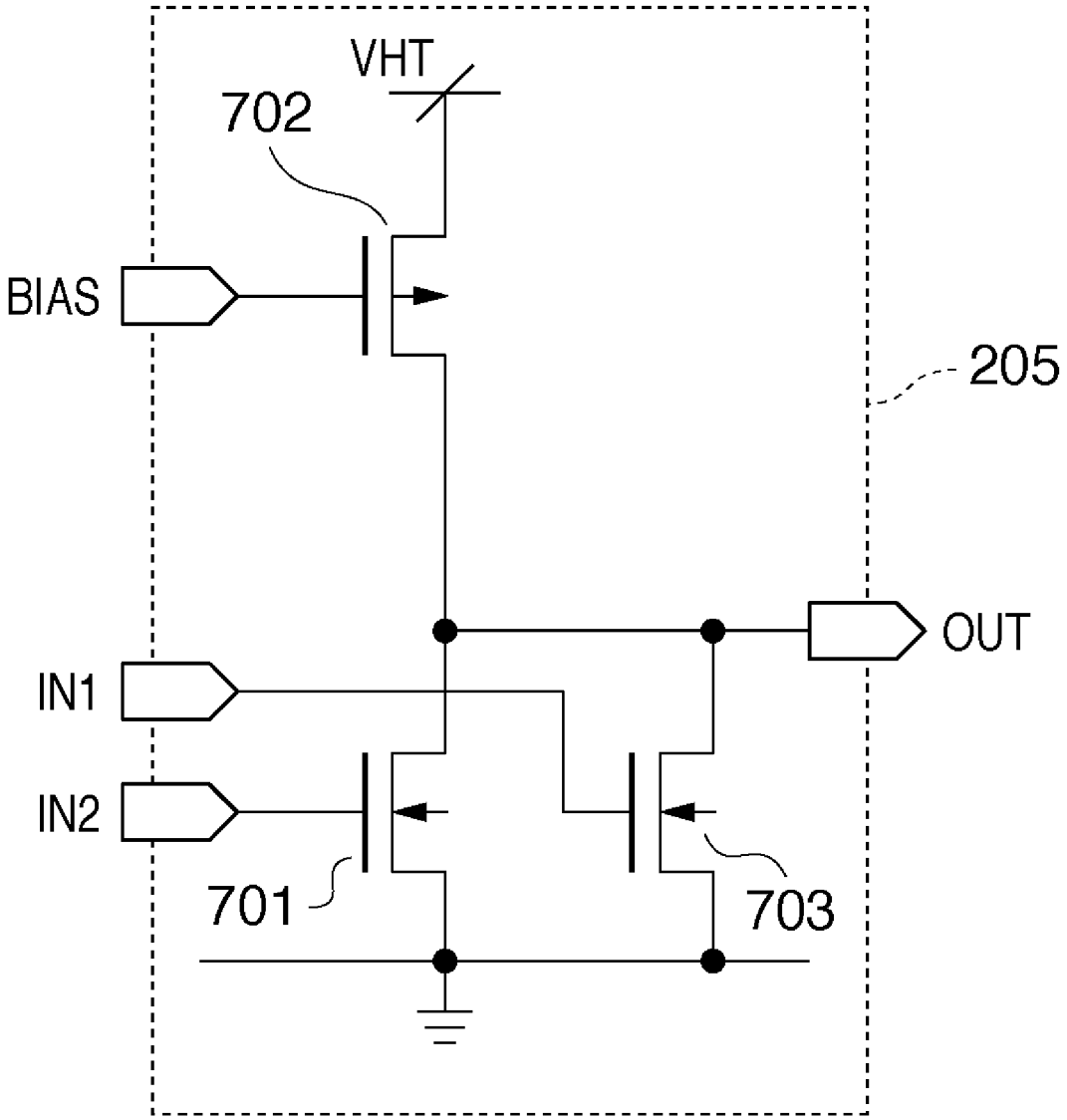
FIG. 11 is a circuit diagram showing the arrangement of a level converter according to the second embodiment.

FIG. 11 is a circuit diagram showing the arrangement of the level converter according to the second embodiment.

In the level converter, a signal which is subjected to level conversion and has the amplitude of the VDD voltage is applied to an NMOS transistor 701 from the terminal IN2 and to an NMOS transistor 703 from the terminal IN1. The level converter outputs an output signal from the OUT terminal.

The OUT terminal of the level converter is connected to the NMOS transistor 701 and a NMOS transistor 703 which are parallel-connected. The OUT terminal is connected via the PMOS transistor 702 series-connected to the NMOS transistor 701 to the VHT power supply serving as a power supply voltage subjected to level conversion. A bias voltage output from the bias circuit 401 is applied to the gate of the PMOS transistor 702.

The operation of this circuit is the same as that in the first embodiment. However, to supply a current to a heater, both signals which have the amplitude of the VDD voltage and are applied to the input terminals IN1 and IN2 need to be set to 0 V.

More specifically, when the VDD voltage is applied to either (or both) of the input terminals IN1 and IN2, the OUT terminal of the level converter outputs 0 V. Only when 0 V is applied to both the input terminals IN1 and IN2, the OUT terminal outputs the VHT voltage. With this arrangement, the level converter according to the second embodiment functions as a 2-input NOR gate having the input terminals IN1 and IN2.

According to the above-described embodiment, a logical operation result by the NOR gate can be used to control driving of the driver transistor on the next stage, so the arrangement of the logic circuit on the preceding stage can be simplified. A NOR gate of two or more inputs can be implemented by increasing the number of parallel-connected NMOS transistors in the level converter and that of input signals.

Third Embodiment

Figure 12:
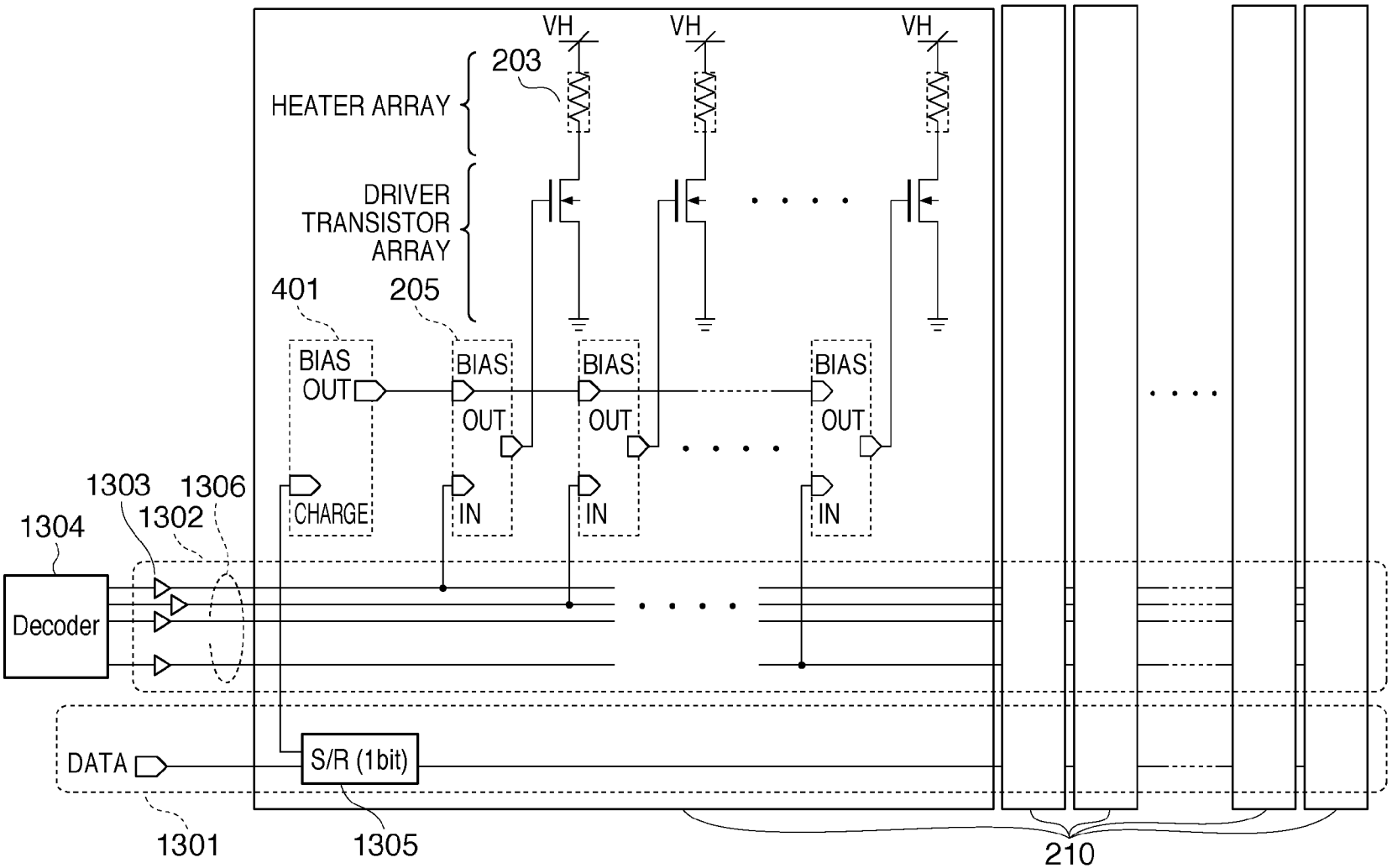
FIG. 12 is a circuit diagram showing the equivalent circuit of a head substrate according to the third embodiment.

FIG. 12 is a circuit diagram showing an equivalent circuit which is integrated on a head substrate and includes a level converter, heater, and driver transistor according to the third embodiment. The third embodiment shows a circuit which time-divisionally drives heaters in accordance with the block. In FIG. 12, the same reference numerals as those described in the prior art and first embodiment denote the same parts, and a description thereof will not be repeated. A bias circuit 401 is identical to that described in the first embodiment with reference to FIG. 7, and a level converter 205 is identical to that described in the first embodiment with reference to FIG. 6.

FIG. 12 shows a plurality of circuit blocks 210. Each circuit block 210 has a 1-bit shift register (S/R) 1305 which serially receives a data signal DATA from a logic circuit (not shown). In synchronism with a clock signal (not shown), the shift register (S/R) 1305 receives the data signal DATA representing whether to select a circuit block including the shift register (S/R) 1305. The shift register (S/R) 1305 latches the data signal DATA in accordance with a latch signal (not shown). An output from the shift register (S/R) in each block is applied to the CHARGE terminal of the bias circuit 401.

In FIG. 12, a circuit surrounded by a broken line 1301 including the shift register (S/R) 1305 operates by the VDD voltage. Thus, a signal applied to the CHARGE terminal has the amplitude of the VDD voltage. This signal functions as an enable signal to select whether to enable/disable each block.

A decoder 1304 decodes a block enable signal input from a logic circuit (not shown). An output signal from the decoder 1304 which selects any heater in the circuit block 210 is supplied to the input terminals IN of the level converters 205. A level converter 1303 amplifies the amplitude of an output from the decoder 1304 up to the VHT voltage, and the resultant output is supplied to the IN terminal. This signal functions as a time-divisional signal to select any one of heaters at any desired timing.

A time-divisional signal 1306 amplified to the amplitude of the VHT voltage by the level converter 1303 is commonly applied to the plurality of circuit blocks 210.

The operation of the circuit block 210 is the same as that in the first embodiment. In the third embodiment, however, the operation of the bias circuit 401 is controlled by an enable signal having the amplitude of the VDD voltage, and the time-divisional signal is controlled by a signal having the amplitude of the VHT voltage. The bias circuit 401 and the level converter 205 corresponding to each heater perform logical combination of the signals having different amplitudes, applying a signal having the amplitude of the VHT voltage to the gate of a driver transistor 204.

Figure 14:
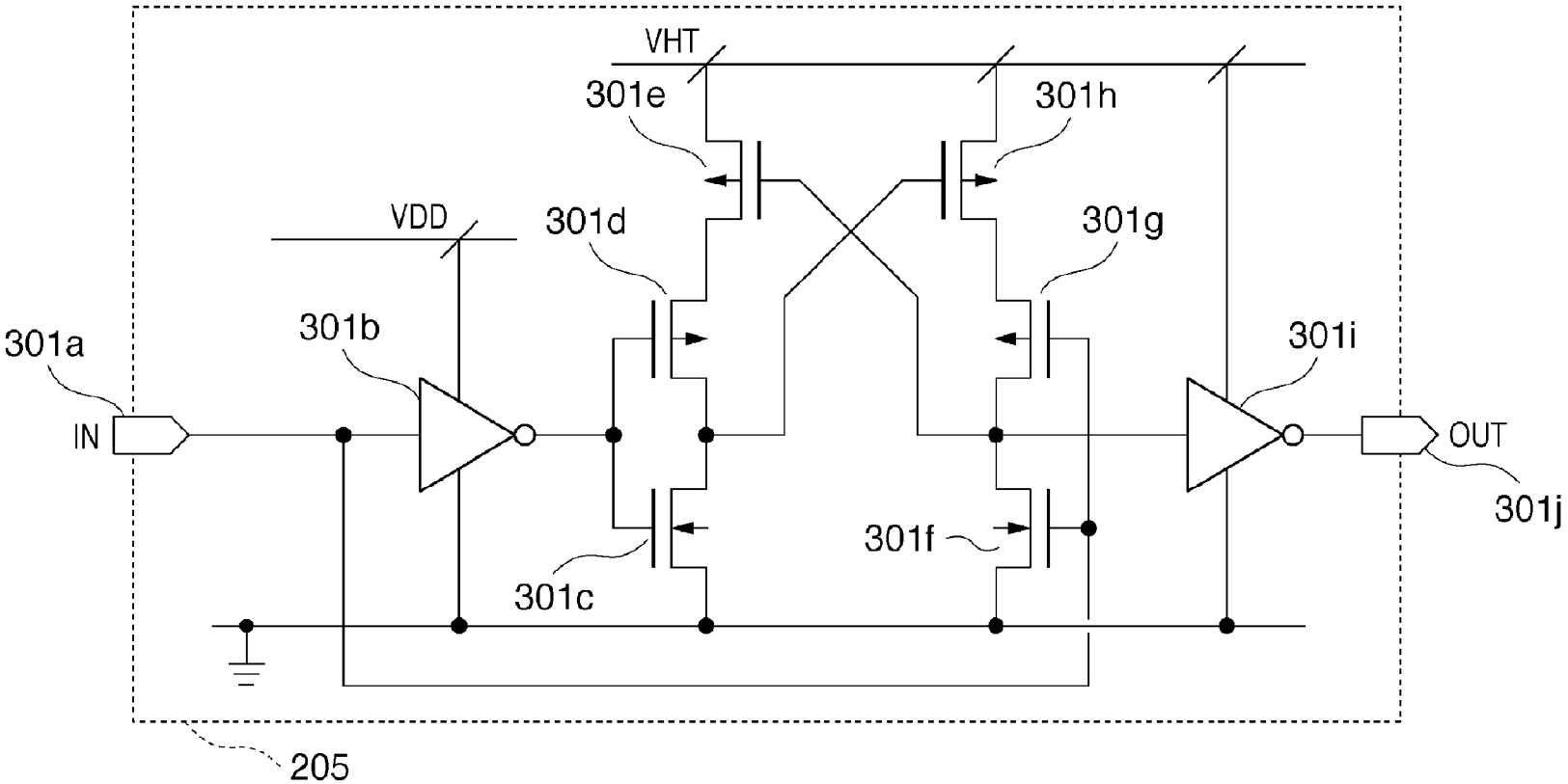
FIG. 14 PRIOR ART
FIG. 14 is a circuit diagram showing an example of the arrangement of a conventional level converter.
Figure 15:
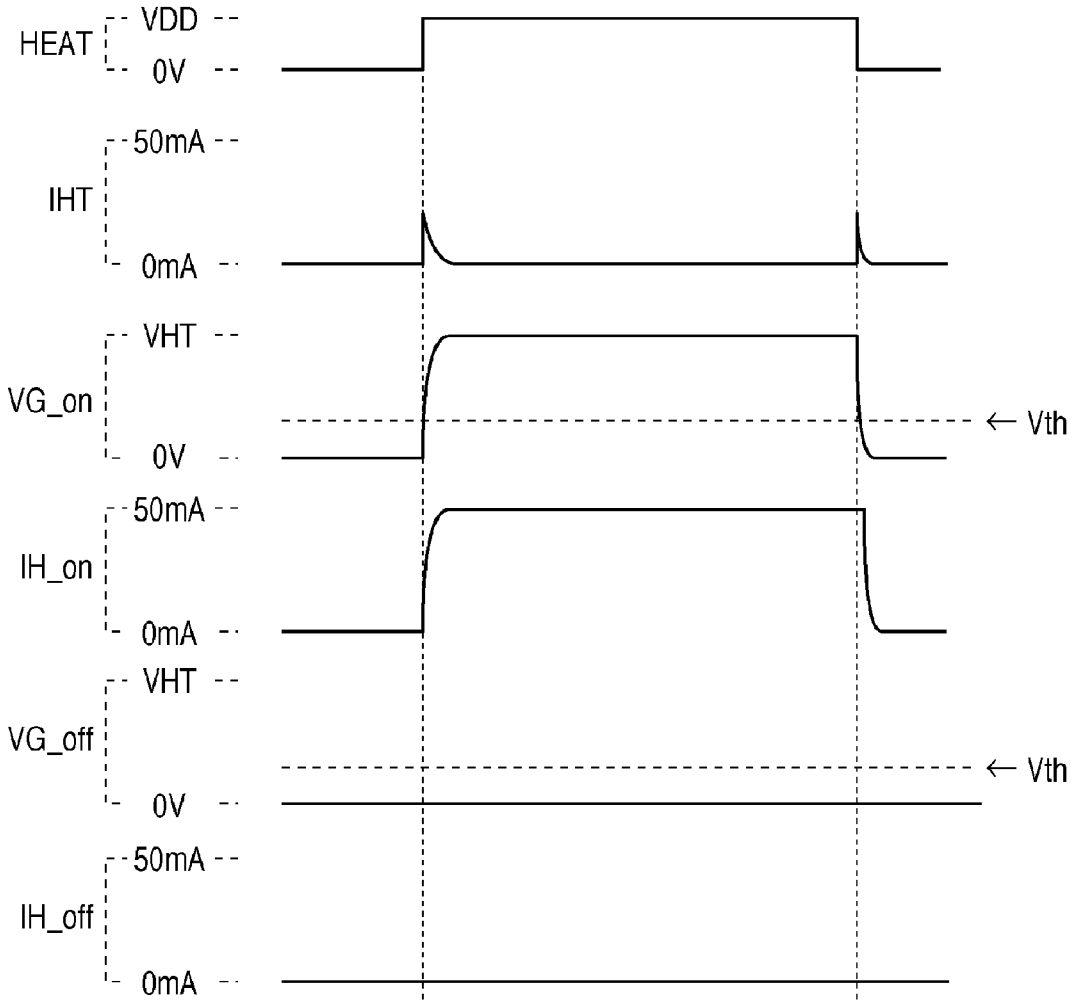
FIG. 15 PRIOR ART
FIG. 15 is a timing chart at the timing to drive the heater of the conventional head substrate.
Figure 16:
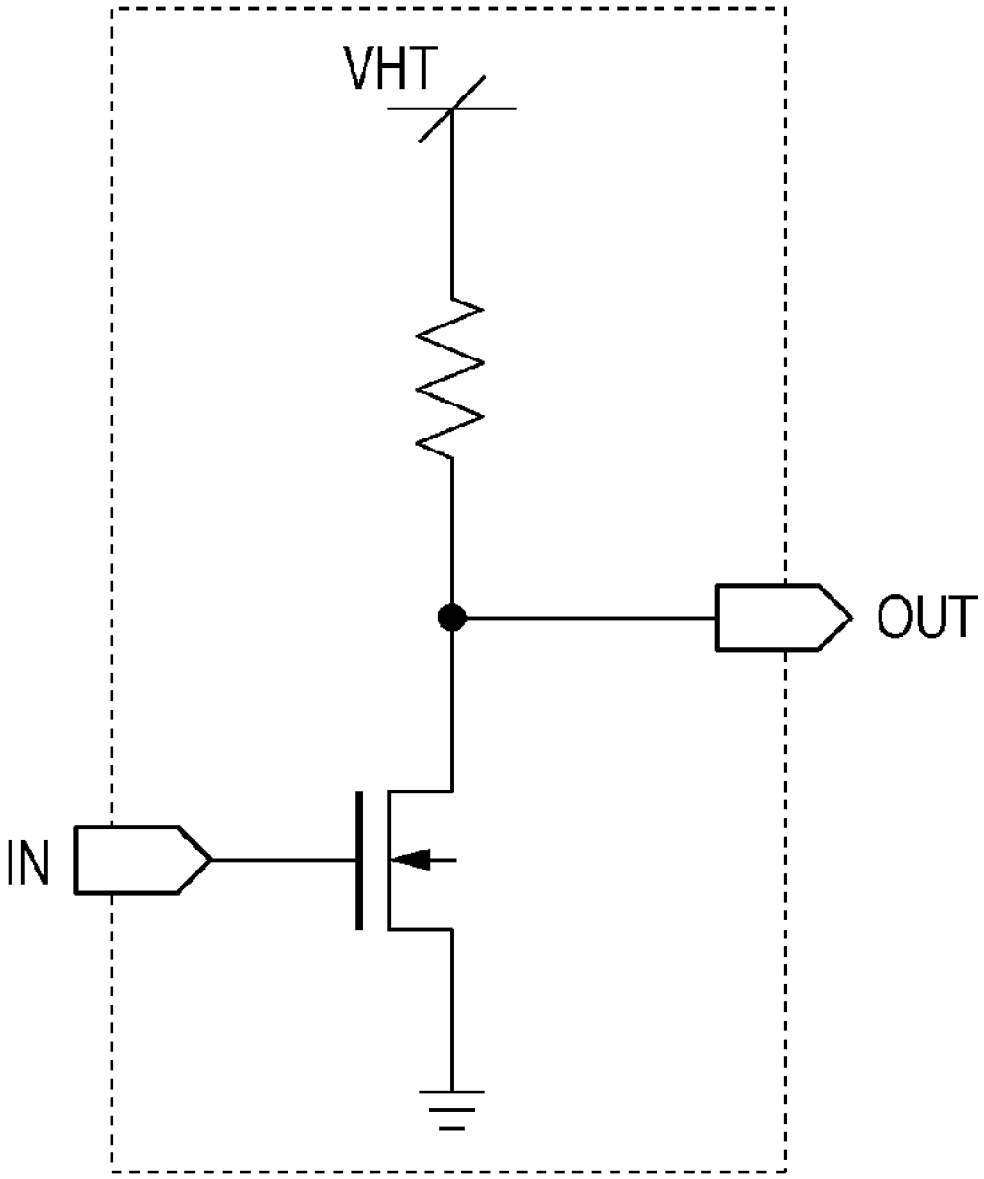
FIG. 16 PRIOR ART
FIG. 16 is a circuit diagram showing a level converter in which an NMOS transistor is series-connected to a resistance load.

In FIG. 12, the level converter 205 according to the present invention is a circuit surrounded by a dotted line shown in FIG. 12. To the contrary, the level converter 1303 has the circuit arrangement of a conventional level converter as shown in FIG. 14. In the third embodiment, the head substrate comprises the level converters 205 equal in number to heaters, and the level converters 1303 equal to the time-divisional count. The level converters 1303 of the third embodiment having the conventional arrangement are arranged by the time-divisional count, and this does not limit a high-density arrangement of elements along the nozzle array of the printhead. It suffices to arrange the level converters 1303 of the time-divisional signal generator by the time-divisional count smaller than the number of conventional level converters (equal to the number of heaters), in order to suppress current consumption.

The arrangement according to the third embodiment can further downsize the level converter 205 of each bit. More specifically, this arrangement can downsize an NMOS transistor 701 in the level converter 205.

In the first and second embodiments, a signal having the amplitude of the VDD voltage is applied to the gate of the NMOS transistor of the level converter. At this time, when a high-level (H) signal is applied to the CHARGE terminal of the bias circuit 401, the PMOS transistor 702 is turned on. Since the NMOS transistor 701 is ON, a level converter 205 set not to supply a current to a heater does not supply a current to it as long as the output voltage from the OUT terminal is equal to or lower than the threshold voltage Vth of the driver transistor 204. However, to make the output from the OUT terminal equal to or smaller than the threshold voltage Vth of the driver transistor 204, the NMOS transistor 701 needs to have a predetermined size or more. Further, a current supplied from the PMOS transistor 702 needs to flow at a drain voltage equal to or lower than the threshold voltage Vth.

To the contrary, in the third embodiment, the gate voltage of the NMOS transistor 701 is set to the VHT voltage higher than the VDD voltage. This makes it possible for even an NMOS transistor with a smaller gate width to supply a current from the PMOS transistor 702 at a sufficiently low drain voltage. As a result, further downsizing can be achieved.

The time-divisional signal 1306 having the amplitude of the VHT voltage is commonly applied to the plurality of blocks 210. It suffices to arrange the level converters 1303 by the time-divisional count. The level converters 1303 can be arranged independently of circuits which need to be arranged for respective heaters at high density.

According to the third embodiment, the level converter performs logical operation and signal amplitude conversion for a time-divisional signal having the amplitude of the VHT voltage from the decoder, and an enable signal having the amplitude of the VDD voltage from the shift register, thereby selectively driving a heater. The third embodiment can further downsize the level converter.

In the above-described embodiments, droplets discharged from the printhead are ink, and the liquid contained in the ink tank is ink. However, the content is not limited to ink. For example, the ink tank may also contain process liquid which is discharged to a print medium in order to improve the fixing characteristic and water repellency of a printed image and improve the image quality.

The above-described embodiments can achieve high print density and high resolution by, of inkjet printing methods, a method of changing the ink state by heat energy generated by a means (e.g., electrothermal transducer) for generating heat energy to discharge ink.

In addition, the inkjet printing apparatus according to the present invention may also take the form of an image output apparatus for an information processing apparatus such as a computer, the form of a copying apparatus combined with a reader or the like, and the form of a facsimile apparatus having transmission and reception functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-228280, filed Sep. 3, 2007, and 2008-218824, filed Aug. 27, 2008, which are hereby incorporated by reference herein in their entirety.

What is claimed is:

1. A head substrate including a plurality of electrothermal transducers divided into a plurality of circuit blocks, each circuit block having a switching element for driving a corresponding electrothermal transducer and a logic circuit for driving the switching element, and each circuit block of the head substrate comprising:

a level converter, arranged with the switching element, which boosts a logic voltage from the logic circuit, and applies the boosted voltage to the switching element, based on a bias signal;

a shift register which receives a data signal representing whether to select said circuit block and outputs the data signal; and a bias circuit which outputs the bias signal, based on the data signal output from the shift register so as to control whether or not to apply the boosted voltage.

2. The head substrate according to claim 1, wherein said bias circuit outputs a bias signal for setting a period during which said plurality of level converters can boost the logic voltage, and commonly inputs the bias signal to said plurality of level converters.

3. The head substrate according to claim 1, wherein said bias circuit applies a bias voltage lower than the boosted voltage to said plurality of level converters, each of said plurality of level converters includes a PMOS transistor, and an NMOS transistor series-connected to the PMOS transistor, a gate of the PMOS transistor receives the bias voltage, a gate of the NMOS transistor receives the logic voltage, and the boosted voltage is output from a node between the PMOS transistor and the NMOS transistor.

4. The head substrate according to claim 1, wherein said bias circuit is formed by series-connecting an NMOS transistor, a current limiter, and a PMOS transistor, a gate of the NMOS transistor receives a signal having an amplitude of the logic voltage, a gate and drain of the PMOS transistor are short-circuited, and the bias voltage is output from a node between the short-circuited gate and drain.

5. The head substrate according to claim 1, wherein each of the plurality of switching elements is a driver transistor which supplies a current to a corresponding electrothermal transducer, and the bias voltage input to a gate of a PMOS transistor included in each of the plurality of level converters changes to turn off the PMOS transistor after charging a gate of the driver transistor.

6. The head substrate according to claim 1, further comprising:

a decoder which generates a time-divisional signal; and another level converter which boosts the time-divisional signal generated by said decoder to generate a time-divisional signal having an amplitude of the boosted voltage, wherein the data signal is input to a gate of an NMOS transistor of said bias circuit, and the boosted time-divisional signal is input to a gate of an NMOS transistor of each of the plurality of level converters.

7. A printhead using a head substrate according to claim 1.

8. An inkjet printhead, using a head substrate according to claim 1, for printing by discharging ink.

9. A head cartridge comprising a head substrate according to claim 1 and an ink tank containing ink to be discharged for printing.

10. A head substrate including a plurality of electrothermal transducers, a plurality of switching elements for respectively driving the plurality of electrothermal transducers, and a logic circuit for driving the plurality of switching elements, the head substrate comprising:

a plurality of level converters which are arranged in correspondence with the respective switching elements, boost a logic voltage from the logic circuit, and apply the boosted voltage to the respective switching elements; and a bias circuit for controlling whether or not to apply the boosted voltage, wherein said bias circuit applies a bias voltage lower than the boosted voltage to said plurality of level converters, each of said plurality of level converters includes a PMOS transistor, and an NMOS transistor series-connected to the PMOS transistor, a gate of the PMOS transistor receives the bias voltage, a gate of the NMOS transistor receives the logic voltage, and the boosted voltage is output from a node between the PMOS transistor and the NMOS transistor.

11. A head substrate including a plurality of electrothermal transducers, a plurality of switching elements for respectively driving the plurality of electrothermal transducers, and a logic circuit for driving the plurality of switching elements, the head substrate comprising:

a plurality of level converters which are arranged in correspondence with the respective switching elements, boost a logic voltage from the logic circuit, and apply the boosted voltage to the respective switching elements; and a bias circuit for controlling whether or not to apply the boosted voltage, wherein said bias circuit is formed by series-connecting an NMOS transistor, a current limiter, and a PMOS transistor, a gate of the NMOS transistor receives a signal having an amplitude of the logic voltage, a gate and drain of the PMOS transistor are short-circuited, and the bias voltage is output from a node between the short-circuited gate and drain.

* * * * *